US011217419B2

(12) United States Patent
Okano et al.

(10) Patent No.: US 11,217,419 B2
(45) **Date of Patent: *Jan. 4, 2022**

(54) DISCHARGE DEVICE AND ELECTRONIC EQUIPMENT

(71) Applicant: SHARP KABUSHIKI KAISHA, Sakai (JP)

(72) Inventors: Satoshi Okano, Sakai (JP); Nobuyuki Ohe, Sakai (JP); Tetsuya Ezaki, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/921,348

(22) Filed: Jul. 6, 2020

(65) Prior Publication Data

US 2021/0012995 A1 Jan. 14, 2021

(30) Foreign Application Priority Data

Jul. 9, 2019 (JP) ..... JP2019-127817

(51) Int. Cl.
*H01T 23/00* (2006.01)
*H01J 27/02* (2006.01)

(52) U.S. Cl.
CPC ..... *H01J 27/022* (2013.01); *H01T 23/00* (2013.01)

(58) Field of Classification Search
None
See application file for complete search history.

(56) References Cited

U.S. PATENT DOCUMENTS 4,423,462 A * 12/1983 Antonevich ..... H01T 19/00 361/235
4,626,876 A * 12/1986 Miyagawa ..... G03G 15/0275 347/127
8,053,741 B2 * 11/2011 Sekoguchi ..... H01T 23/00 250/424
10,998,159 B2 * 5/2021 Ohe ..... H01J 27/08
2011/0102963 A1 * 5/2011 Sekoguchi ..... F24F 8/192 361/230
2011/0115362 A1 * 5/2011 Sekoguchi ..... H01T 23/00 313/230
2019/0192722 A1 * 6/2019 Date ..... H01T 23/00

FOREIGN PATENT DOCUMENTS

JP 2011-037650 A 2/2011
JP 2013-004416 A 1/2013

* cited by examiner

*Primary Examiner* — Stephen W Jackson
(74) *Attorney, Agent, or Firm* — ScienBiziP, P.C.

(57) ABSTRACT

An ion generating device includes a high voltage transformer, a discharge electrode connected to a terminal of the high voltage transformer on a secondary side, and an induction electrode that generates ions between the induction electrode and the discharge electrode and is connected to a terminal of the high voltage transformer on the secondary side. A first conductive path includes the terminal and extends from the terminal to the discharge electrode and a second conductive path includes a terminal and the induction electrode. Part of the first conductive path is located in proximity and opposed to part of the second conductive path.

8 Claims, 7 Drawing Sheets

DISCHARGE DEVICE AND ELECTRONIC EQUIPMENT

BACKGROUND

1. Field

The present disclosure relates to a discharge device that reduces noise associated with high voltage discharge.

2. Description of the Related Art

A discharge device causes high voltage discharge between a discharge electrode and an induction electrode and thereby generates a discharged product. The discharge device includes a high voltage generating unit to generate a pulse high voltage used for high voltage discharge. The high voltage generating unit generates electromagnetic noise such as radiation noise or induction noise.

Such electromagnetic noise is propagated to equipment, in which the discharge device is mounted, from a drive circuit of the discharge device through a power line. Moreover, when the electromagnetic noise leaks outside through a power cord of the equipment, the electromagnetic noise may affect another equipment using the power supply system that is shared with the equipment. Therefore, the equipment affected by the electromagnetic noise may erroneously operate.

In order to deal with such inconvenience, a component such as a line filter to remove noise is usually provided in equipment. There are also countermeasures as disclosed in Japanese Unexamined Patent Application Publication No. 2011-37650 and Japanese Unexamined Patent Application Publication No. 2013-4416.

Japanese Unexamined Patent Application Publication No. 2011-37650 discloses an ozone generating device that includes a pulse generator capable of generating a pulse voltage, a plurality of electrodes to which the pulse voltage is applied, and a discharge reactor that generates ozone by discharge generated between the plurality of electrodes. The ozone generating device includes a first shield that covers a magnetic pulse compression circuit in the pulse generator to shield the magnetic pulse compression circuit from electromagnetic noise and a second shield that is separate from the first shield and covers the discharge reactor.

Japanese Unexamined Patent Application Publication No. 2013-4416 discloses an ion generating device that includes a power control unit that controls the whole device and a high voltage generating circuit that generates a high voltage, which is applied to a discharge unit, in response to an instruction from the power control unit. In the ion generating device, the power control unit is provided on a first substrate, the high voltage generating circuit is provided on a second substrate disposed at a position different from the first substrate, and thus the power control unit is less likely to be affected by magnetic noise generated in the high voltage generating unit.

The device disclosed in Japanese Unexamined Patent Application Publication No. 2011-37650 uses two shields that are separate from each other. Thus, there is a problem that the device is difficult to be reduced in size.

Moreover, according to the device disclosed in Japanese Unexamined Patent Application Publication No. 2013-4416, conduction noise among noise generated by the device is able to be reduced easily, but the first substrate and the second substrate are greatly separated from each other to reduce radiation noise and induction noise. Therefore, the device disclosed in Japanese Unexamined Patent Application Publication No. 2013-4416 is also difficult to be reduced in size.

An aspect of the disclosure aims to achieve a discharge device that is small and is capable of reducing noise.

SUMMARY

A discharge device according to an aspect of the disclosure includes a transformer, a discharge electrode that is connected to a first terminal of the transformer on a secondary side, and an induction electrode that generates a discharged product between the induction electrode and the discharge electrode and is connected to a second terminal of the transformer on the secondary side, in which a first conductive path includes the first terminal and extends from the first terminal to the discharge electrode and a second conductive path includes the second terminal and the induction electrode, part of the first conductive path being located in proximity and opposed to part of the second conductive path.

DESCRIPTION OF THE EMBODIMENTS

Embodiment 1

An ion generating device that generates ions as a discharged product is described in all embodiments including the present embodiment. However, the disclosure is not limited to the ion generating device and may be applied to any discharge device that generates, by electric discharge, particles (discharged product), for example, electrons, ozone, radical, or active species, which have a high energy state from gas.

Embodiment 1 of the disclosure is described as follows with reference to FIGS. 1 to 6.

Figure 1:
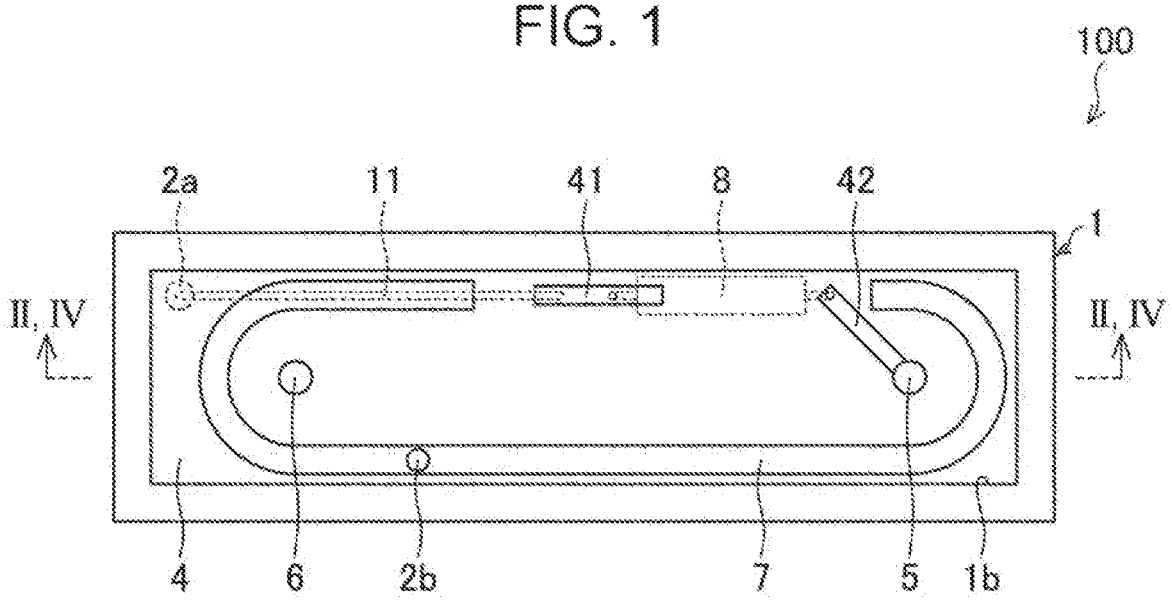
FIG. 1 is a plan view illustrating a configuration of an ion generating device according to Embodiment 1 of the disclosure.
Figure 2:
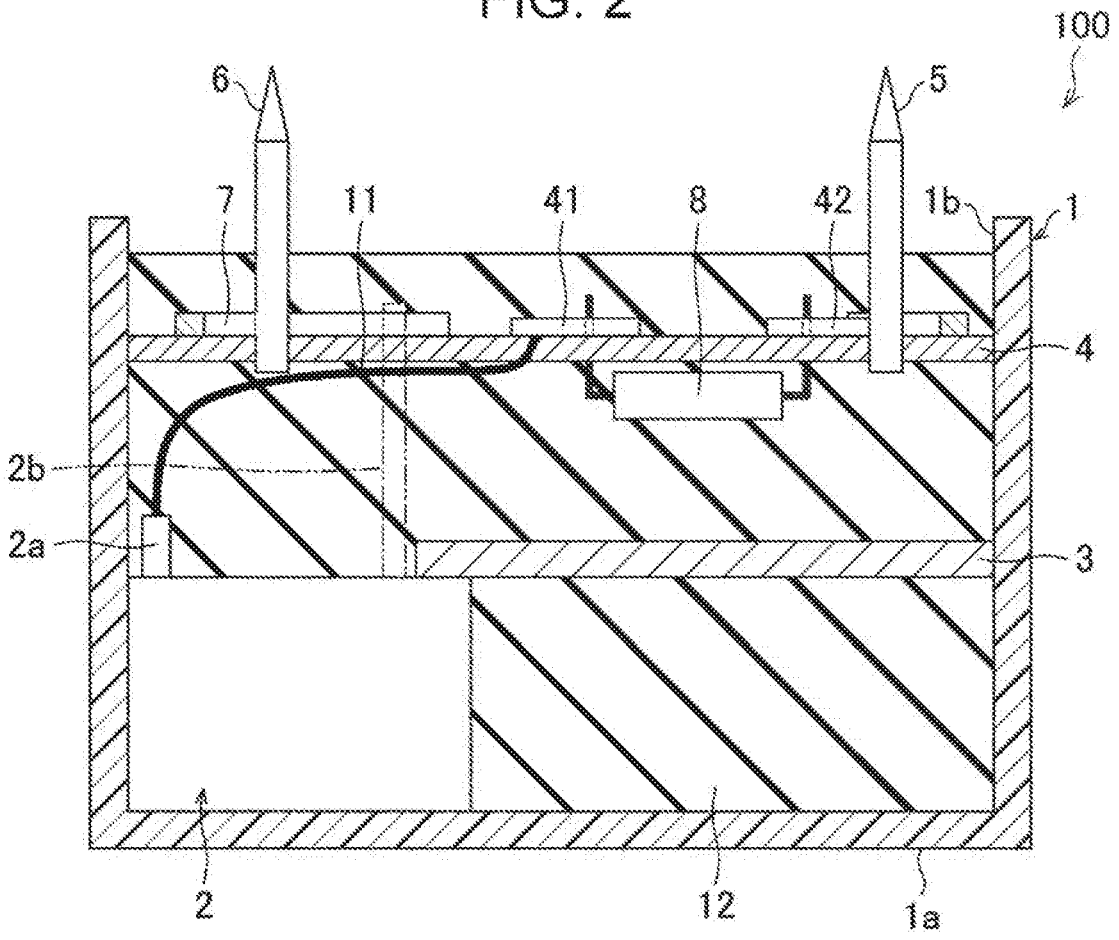
FIG. 2 is a sectional view taken along line II, IV-II, IV in FIG. 1.
Figure 3:
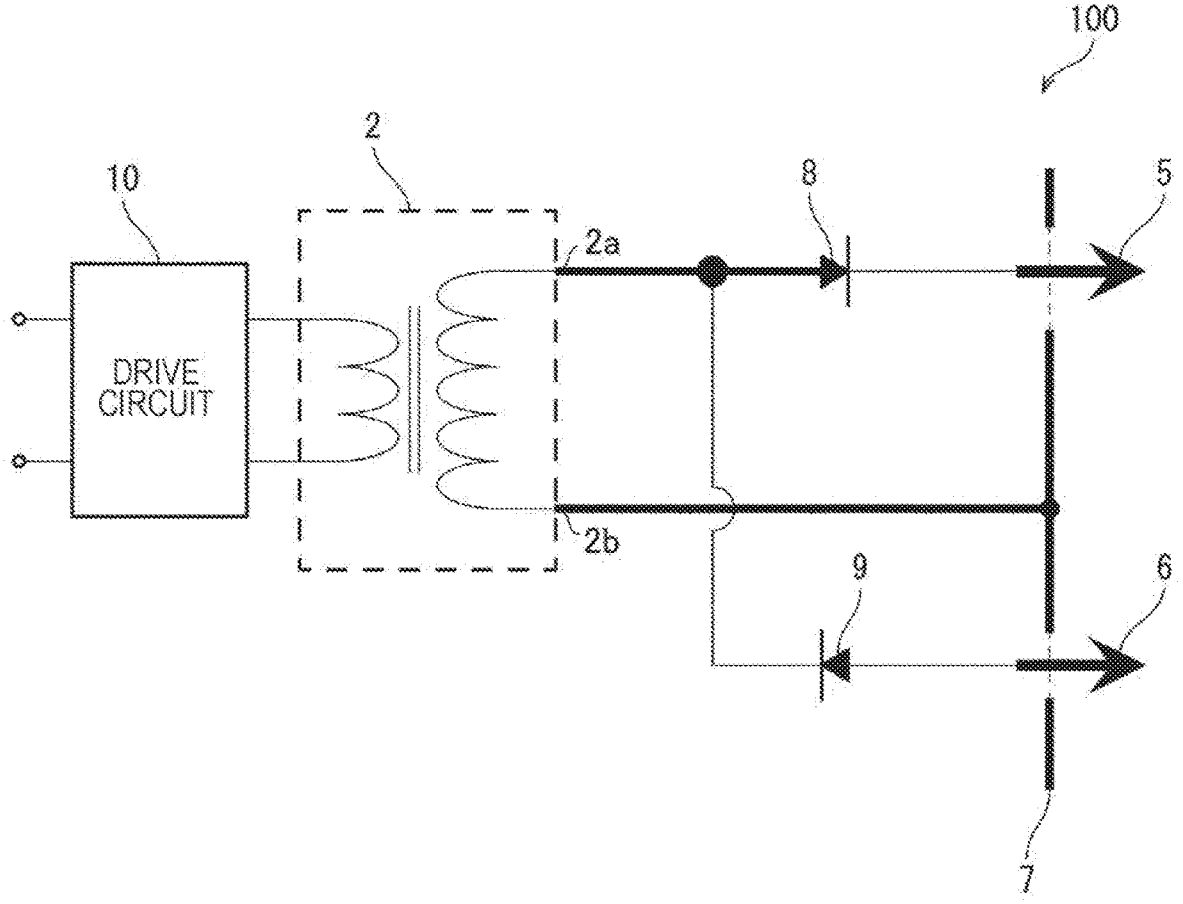
FIG. 3 is a circuit diagram illustrating a circuit configuration of the ion generating device.

FIG. 1 is a plan view illustrating a configuration of an ion generating device 100 according to the present embodiment. FIG. 2 is a sectional view taken along line II, IV-II, IV in FIG. 1. FIG. 3 is a circuit diagram illustrating a circuit configuration of the ion generating device 100.

The ion generating device 100 (discharge device) is a device that generates ions by performing discharge in the air.

As illustrated in FIGS. 1 to 3, the ion generating device 100 includes a housing 1, a high voltage transformer 2 (transformer), a drive circuit substrate 3, a high voltage circuit substrate 4 (substrate), discharge electrodes 5 and 6, an induction electrode 7, diodes 8 and 9, a drive circuit 10, a lead wire 11 (wire member), and an insulating sealing material 12.

As illustrated in FIGS. 1 and 2, the housing 1 is made of insulating resin and formed into a box shape. The housing 1 has a bottom portion 1*a* and an opening 1*b*. The bottom portion 1*a* is provided at a lower-end surface (lower surface in the example of FIGS. 1 and 2) that includes a long side and a short side of three sides that define the box shape of the housing 1. The opening 1*b* is provided at an upper-end surface (upper surface in the example of FIGS. 1 and 2) that includes the long side and the short side described above.

The high voltage transformer 2, the drive circuit substrate 3, and the high voltage circuit substrate 4 are accommodated in the housing 1 in this order from the bottom portion 1*a* to the opening 1*b*. Moreover, the housing 1 is filled with the insulating sealing material 12. An insulating material, for example, epoxy resin, urethane resin, or the like is used as the insulating sealing material 12.

The high voltage transformer 2, the drive circuit substrate 3, and the high voltage circuit substrate 4 are electrically insulated from each other by the insulating sealing material 12. Moreover, since the opening 1 is sealed by the insulating sealing material 12, dust or the like is prevented from covering the high voltage transformer 2, the drive circuit substrate 3, and the high voltage circuit substrate 4 even when a lid is not provided for the opening 1*b*.

The drive circuit substrate 3 is a circuit substrate that is long and narrow and has a substantially rectangular shape. The drive circuit 10 is disposed on the drive circuit substrate 3. The drive circuit 10 converts a direct-current (DC) voltage used in equipment in which the ion generating device 100 is mounted into an alternating-current (AC) voltage having a predetermined frequency and applies the converted AC voltage to a primary coil of the high voltage transformer 2 to thereby drive the high voltage transformer 2. The high voltage transformer 2 is a transformer that raises the AC voltage applied by the drive circuit 10.

The high voltage circuit substrate 4 is a single circuit substrate that is long and narrow and has a substantially rectangular shape. The discharge electrodes 5 and 6 and the induction electrode 7 are provided on the high voltage circuit substrate 4. The high voltage circuit substrate 4 is a substrate (one-sided substrate) only a front surface (upper surface) of which is used to form the discharge electrodes 5 and 6, the induction electrode 7, and a conductive pattern such as a wiring pattern.

The discharge electrode 5 is attached to one end of the high voltage circuit substrate 4, and the discharge electrode 6 is attached to the other end of the high voltage circuit substrate 4. The discharge electrodes 5 and 6 are disposed so as to vertically rise from the front surface of the high voltage circuit substrate 4 and to protrude from a surface of the insulating sealing material 12. Part of the discharge electrodes 5 and 6 is exposed externally from the opening 1*b* of the housing 1. The discharge electrodes 5 and 6 are sharp-pointed needle-like electrodes. The discharge electrodes 5 and 6 are not limited to the needle-like electrodes and may be electrodes having brush-like tips, or the like.

The induction electrode 7 is provided on the front surface of the high voltage circuit substrate 4. The induction electrode 7 is formed around the discharge electrode 5 and the discharge electrode 6 except in an area between the discharge electrodes 5 and 6 which are opposed to each other, and has a linear portion formed to connect those portions of the induction electrode 7 around the discharge electrode 5 and the discharge electrode 6.

The induction electrode 7 is an electrode provided to form an electric field between the induction electrode 7 and the discharge electrode 5 or 6. The discharge electrode 5 is an electrode provided to generate positive ions between the discharge electrode 5 and the induction electrode 7. The discharge electrode 6 is an electrode provided to generate negative ions between the discharge electrode 6 and the induction electrode 7.

The diodes 8 and 9 are interposed between one terminal 2*a* (first terminal) of the high voltage transformer 2 on a secondary side and the discharge electrodes 5 and 6, respectively. The diode 8 half-wave rectifies an AC voltage output from the high voltage transformer 2 and thereby outputs a positive half cycle of the AC voltage. Moreover, the diode 9 half-wave rectifies an AC voltage output from the high voltage transformer 2 and thereby outputs a negative half cycle of the AC voltage. An anode of the diode 8 and a cathode of the diode 9 are connected to the terminal 2*a*. A cathode of the diode 8 is connected to the discharge electrode 5. An anode of the diode 9 is connected to the discharge electrode 6.

The other terminal 2*b* (second terminal) of the high voltage transformer 2 on the secondary side is connected to the induction electrode 7. In this manner, the secondary side of the high voltage transfer 2 is not grounded in the ion generating device 100.

When electric power is supplied from the drive circuit 10 to the high voltage transformer 2, electric discharge is generated between the discharge electrodes 5 and 6 and the induction electrode 7 and ions are generated. Components constituting a circuit of the ion generating device 100 are not restrictive and known components are able to be used.

As illustrated in FIGS. 1 and 2, the terminals 2*a* and 2*b* are provided on an upper surface of the high voltage transformer 2. The terminal 2*a* is disposed on the upper surface of the high voltage transformer 2 in a corner close to the discharge electrode 6 and is short in length. The terminal 2*b* is disposed on the upper surface of the high voltage transformer 2 near a corner diagonally positioned with respect to the corner, at which the terminal 2*a* is provided, and is long in length so as to penetrate the high voltage circuit substrate 4. The terminal 2*b* is connected to the induction electrode 7 at a tip portion thereof.

Note that, in order to ensure an appropriate number of turns of a coil on the secondary side of the high voltage transformer 2, the terminals 2*a* and 2*b* are requested to be disposed with a certain interval therebetween. Therefore, it is difficult to dispose the terminals 2*a* and 2*b* close to each other.

The diode 8 is mounted on a rear surface (lower surface) side of the high voltage circuit substrate 4. An anode terminal and a cathode terminal of the diode 8 penetrate the high voltage circuit substrate 4. The terminal 2*a* of the high voltage transformer 2 and the anode terminal of the diode 8 are connected via the lead wire 11 and a wiring pattern 41 formed on the front surface of the high voltage circuit substrate 4. The cathode terminal of the diode 8 and the discharge electrode 5 are connected via a wiring pattern 42 formed on the front surface of the high voltage circuit substrate 4.

Further, although not illustrated in FIGS. 1 and 2, the diode 9 is also mounted on the rear surface side of the high voltage circuit substrate 4 and the anode terminal and the cathode terminal of the diode 9 penetrate the high voltage circuit substrate 4. The terminal 2*a* of the high voltage transformer 2 and the cathode terminal of the diode 9 are connected via the lead wire 11 and a wiring pattern (not illustrated) that is formed on the front surface of the high voltage circuit substrate 4. The anode terminal of the diode 9 and the discharge electrode 6 are connected via another wiring pattern (not illustrated) that is formed on the front surface of the high voltage circuit substrate 4.

One end of the lead wire 11 is connected to the terminal 2*a*, and the other end of the lead wire 11 penetrates the high voltage circuit substrate 4 and is connected to the wiring pattern 41. As illustrated in FIG. 1, part of the lead wire 11 and part of the induction electrode 7 are overlapped with each other in plan view in FIG. 1, and are opposed to each other. Further, as illustrated in FIG. 2, the lead wire 11 is disposed so as to extend at a steep angle from a position, at which the lead wire 11 is connected to the terminal 2*a*, toward the high voltage circuit substrate 4, and so as to be substantially parallel to the rear surface (lower surface) of the high voltage circuit substrate 4 from a vicinity of a lower end of the discharge electrode 6 to a position at which the lead wire 11 penetrates the high voltage circuit substrate 4. Accordingly, part of the lead wire 11 is substantially parallel to part of the induction electrode 7.

Next, a noise reduction effect according to the arrangement of the lead wire 11 is described.

Figure 4:
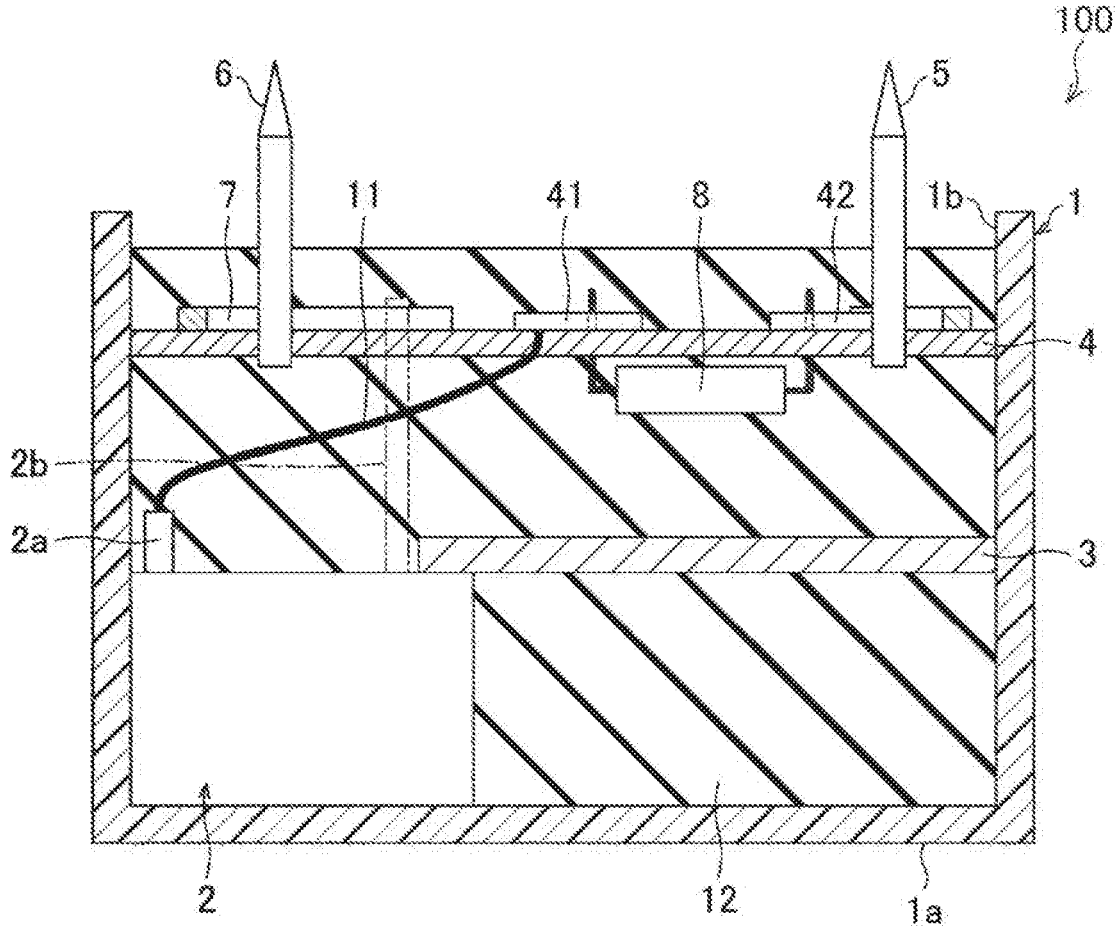
FIG. 4 is a sectional view taken along line II, IV-II, IV in FIG. 1 and illustrating another configuration of the ion generating device.

FIG. 4 is a sectional view taken along line II, IV-II, IV in FIG. 1 and illustrating another configuration of the ion generating device 100.

First, an ion generating device as a reference, in which no anti-noise measure is taken, is described. The ion generating device (not illustrated) does not include the lead wire 11. The terminal 2*a* has a length similar to the length of the terminal 2*b* reaching the high voltage circuit substrate 4 and is connected to the diodes 8 and 9 via a wiring pattern provided on the high voltage circuit substrate 4. The ion generating device thus configured generates the highest noise.

On the other hand, part of the lead wire 11 and part of the induction electrode 7 are disposed so as to be parallel in the ion generating device 100 illustrated in FIGS. 1 and 2. Accordingly, reduction of noise by approximately 20 dB is confirmed as compared to noise generated by the ion generating device as a reference.

Further, although the ion generating device 100 illustrated in FIG. 4 does not have a portion where the lead wire 11 and the induction electrode 7 are disposed in parallel, the lead wire 11 is opposed to the induction electrode 7 and disposed so as to be inclined with respect to the high voltage circuit substrate 4. Reduction of noise by approximately 13 dB as compared to the noise generated by the ion generating device as a reference, which is not as effective as the noise reduction effect of the ion generating device 100 illustrated in FIGS. 1 and 2, is confirmed in the ion generating device 100 illustrated in FIG. 4.

As a length in which the lead wire 11 and the induction electrode 7 are opposed is longer, the noise reduction effect is able to be enhanced. Further, a distance D between the opposing lead wire 11 and induction electrode 7 is preferably more than 0 mm and 5 mm or less (0 mm<D≤5 mm), and a practically sufficient noise reduction effect is confirmed when the value is in the range. When the distance D is more than 5 mm and 10 mm or less (5 mm<D≤10 mm), a good noise reduction effect is obtained near 5 mm, which is close to the noise reduction effect obtained at an upper limit value (D=5 mm) in the range of 0 mm<D≤5 mm. Further, in the range of 5 mm<D≤10 mm, noise reduction effect which is enough for practical use is confirmed near 10 mm, though the noise reduction effect is insufficient as compared to the noise reduction effect in the range of 0 mm<D≤5 mm.

In addition, the lead wire 11 may be in contact with the high voltage circuit substrate 4 as long as the lead wire 11 and the high voltage circuit substrate 4 are insulated from each other. In such a case, the lead wire 11 is located in proximity to the induction electrode 7 with an interval corresponding to a thickness (about 0.8 mm) of the high voltage circuit substrate 4. Even when the lead wire 11 and the induction electrode 7 are located in proximity to such an extent, the noise reduction effect is obtained.

Note that, though the induction electrode 7 is disposed on an upper side of the high voltage circuit substrate 4 in FIGS. 1 and 4, an equivalent noise reduction effect is confirmed in the same range as the aforementioned range of the distance D in a case where the induction electrode 7 is disposed on a lower side of the high voltage circuit substrate 4.

Here, the lead wire 11 and the induction electrode 7 are located in proximity in a top-bottom direction that is a direction in which the drive circuit substrate 3 and the high voltage circuit substrate 4 are overlapped. Moreover, the lead wire 11 and the induction electrode 7 may be continuously located in proximity or intermittently (discontinuously) located in proximity.

In this manner, as illustrated in FIG. 4, part of a first conductive path that extends from the terminal 2*a* of the high voltage transformer 2 to the discharge electrodes 5 and 6 and part of a second conductive path that includes the terminal 2*b* of the high voltage transformer 2 and the induction electrode 7 are located in proximity and opposed to each other in the ion generating device 100 of the present embodiment. As illustrated in FIGS. 1 and 2, the first conductive path herein is a conductive path constituted by the terminal 2*a*, the lead wire 11, the wiring pattern 41, the diode 8, and the wiring pattern 42. Further, the first conductive path is a conductive path constituted by the terminal 2*a*, the lead wire 11, a wiring pattern (not illustrated) that connects the lead wire 11 and the diode 9, the diode 9, and a wiring pattern (not illustrated) that connects the diode 9 and the discharge electrode 6. The second conductive path herein is constituted by the terminal 2*b* and the induction electrode 7. The lead wire 11 that is part of the first conductive path and part of the induction electrode 7 that is part of the second conductive path are located in proximity and opposed, and further, substantially parallel to each other.

Since the secondary side of the high voltage transformer 2 is not grounded, waveforms of voltages appearing at the respective terminals 2*a* and 2*b* of the high voltage transformer 2 have opposite phases. Therefore, electromagnetic noise generated in the first conductive path and electromagnetic noise generated in the second conductive path also have phases opposite to each other. Thus, since part of the first conductive path and part of the second conductive path are opposed to each other, at least part of the electromagnetic noise generated in the first conductive path and at least part of the electromagnetic noise generated in the second conductive path are cancelled each other. Moreover, in a portion where the first conductive path and the second conductive path are parallel to each other, an effect of cancelling the electromagnetic noise is further enhanced.

Accordingly, a shield or the like that shields against electromagnetic noise is not provided. As a result, the ion generating device 100 in small size and capable of reducing noise is able to be achieved.

Moreover, since the lead wire 11 in the first conductive path is opposed to the second conductive path, the first conductive path and the second conductive path are able to be easily opposed to each other by appropriately adjusting arrangement and/or a shape of the lead wire 11.

The lead wire 11 may have flexibility, but when the lead wire 11 has flexibility, it may be difficult to keep a shape substantially parallel to the induction electrode 7. In this regard, the lead wire 11 may be formed of a conductive material that is deformable by external force and that is rigid to an extent that a deformed shape is kept. This makes it possible to easily keep the shape that is substantially parallel to the induction electrode 7. Moreover, the lead wire 11 may be a shape-memory alloy that is deformed into a prescribed shape when predetermined heat is applied.

Meanwhile, the high voltage circuit substrate 4 is the one-sided substrate and no wiring pattern is formed on the rear surface facing the high voltage transformer 2. Therefore, even if the periphery of the lead wire 11 is not insulated, the lead wire 11 does not cause a short-circuit fault with a wiring pattern if the lead wire 11 is in contact with the rear surface of the high voltage circuit substrate 4. In a case where the high voltage circuit substrate 4 is, however, a double-sided substrate with a wiring pattern also formed on the rear surface thereof, when the periphery of the lead wire 11 is not insulated, the lead wire 11 causes a short-circuit fault with a wiring pattern if the lead wire 11 is in contact with the rear surface of the high voltage circuit substrate 4. Accordingly, in such a case, the lead wire 11 is, like a fluororesin tube, desirably coated with an insulating coating member in order to avoid a short-circuit fault.

Moreover, the high voltage circuit substrate 4 is a single substrate on which the discharge electrodes 5 and 6 and the induction electrode 7 are provided. This makes it possible to reduce the number of components as compared to a case where the discharge electrodes 5 and 6 and the induction electrode 7 are formed on individual substrates. Thus, it is possible to reduce cost of the ion generating device 100.

In the present embodiment, the ion generating device 100 in a longitudinal type in which the high voltage circuit substrate 4, the drive circuit substrate 3, and the high voltage transformer 2 are disposed in the top-bottom direction has been described. The disclosure is not limited to such a configuration and is also able to be applied to an ion generating device having a configuration in which a high voltage transformer having a structure different from that of the high voltage transformer 2 is disposed in a lateral direction with respect to the high voltage circuit substrate 4 and the drive circuit substrate 3, for example. In such a configuration, the high voltage transformer has, on a side surface thereof, a terminal on a secondary side, and a lead wire is able to be disposed so as to extend from the terminal to a lower side or an upper side of the high voltage circuit substrate 4 located in the lateral direction.

Next, a modification of the present embodiment is described.

Figure 5:
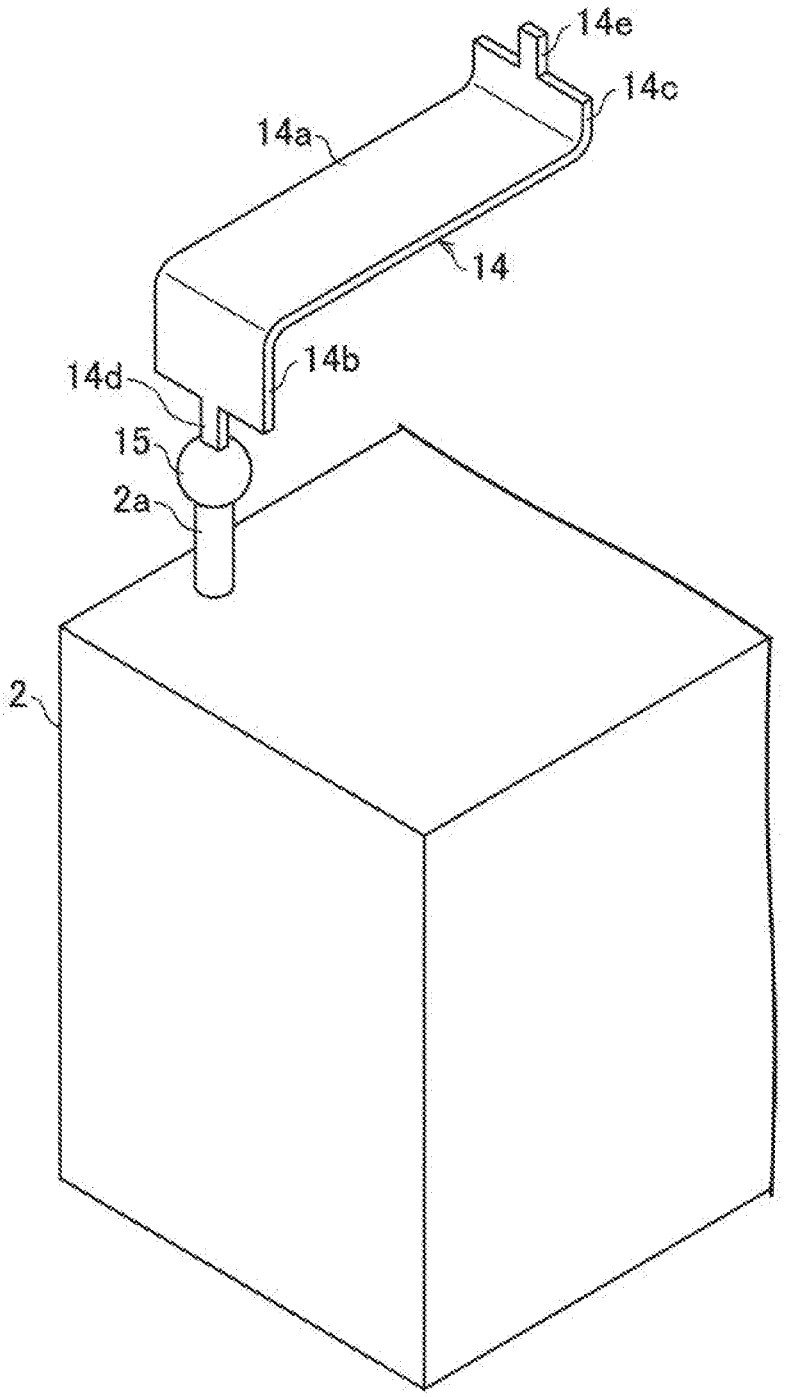
FIG. 5 is a perspective view illustrating a conductor connected to a high voltage transformer in an ion generating device according to a modification of Embodiment 1.

FIG. 5 is a perspective view illustrating a conductor 14 connected to the high voltage transformer 2 in an ion generating device 100 according to the modification of the present embodiment.

As illustrated in FIG. 5, the conductor 14 may be used instead of the lead wire 11 in the ion generating device 100. The conductor 14 is formed of a conductive material in a plate shape and has a body 14*a*, a falling portion 14*b*, a rising portion 14*c*, and connection portions 14*d* and 14*e*.

The body 14*a* is formed in a rectangle having a long and narrow flat plate shape. The conductor 14 is disposed so that the body 14*a* is substantially parallel to the induction electrode 7. The conductor 14 may be formed of a thin material like metal foil or formed of a metal material of a thin plate shape thicker than metal foil.

The falling portion 14*b* having the same width as the body 14*a* is formed at one end of the body 14*a* so as to face downward (face the high voltage transformer 2). The rising portion 14*c* having the same width as the body 14*a* is formed at the other end of the body 14*a* so as to face upward (face the high voltage circuit substrate 4).

The connection portion 14*d* protrudes from a lower end of the falling portion 14*b* and has a width narrower than the falling portion 14*b*. The connection portion 14*d* is connected to the terminal 2*a* of the high voltage transformer 2 by solder 15. The connection portion 14*e* protrudes from an upper end of the rising portion 14*c* and has a width narrower than the rising portion 14*c*. The connection portion 14*e* is connected by solder to the wiring pattern 41 on the high voltage circuit substrate 4, which is not illustrated in FIG. 5.

By using the conductor 14 as described above, it is possible to ensure a width wider than the width of the lead wire 11. As a result, an area in which the first conductive path and the second conductive path are opposed to each other is made large.

Embodiment 2

Embodiment 2 of the disclosure is described as follows with reference to FIG. 6. Note that, for convenience of description, an element having the same function as that of the element described in Embodiment 1 is given the same reference sign and description thereof is omitted.

Figure 6:
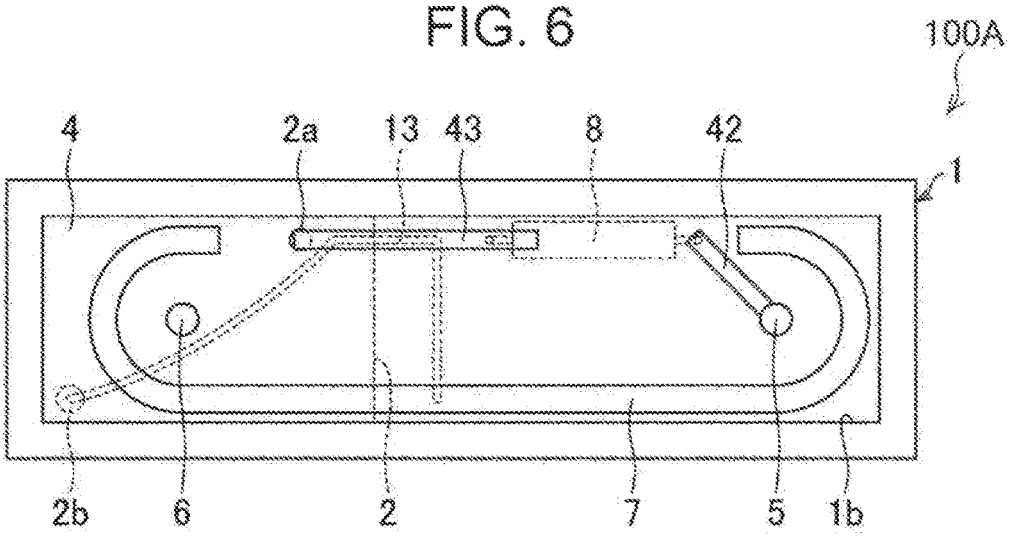
FIG. 6 is plan view illustrating a configuration of an ion generating device according to Embodiment 2 of the disclosure.

FIG. 6 is a plan view illustrating a configuration of an ion generating device 100A according to the present embodiment.

In the present embodiment, a part different from the ion generating device 100 of Embodiment 1 described above is mainly described.

As illustrated in FIG. 6, the ion generating device 100A is different from the ion generating device 100 in that a wiring pattern 43 longer than the wiring pattern 41 (refer to FIG. 1) is provided on the high voltage circuit substrate 4 instead of the wiring pattern 41. Further, the ion generating device 100A has a lead wire 13 instead of the lead wire 11 (refer to FIG. 1).

One end of the wiring pattern 43 is connected to the anode terminal of the diode 8 in the same manner as the wiring pattern 41, but the other end thereof toward the high voltage transformer 2 has a length reaching an area where the upper surface of the high voltage transformer 2 is projected on the high voltage circuit substrate 4. Accordingly, the induction electrode 7 is short in length such that an end of the induction electrode 7 near the high voltage transformer 2 is located at a position closer to the discharge electrode 6 as compared to the induction electrode 7 in the ion generating device 100.

The terminals 2*a* and 2*b* in the high voltage transformer 2 are different from the terminals 2*a* and 2*b* in the high voltage transformer 2 of the ion generating device 100.

Specifically, the terminal 2*a* is disposed on the upper surface of the high voltage transformer 2 below the other end of the wiring pattern 43 and has a length such that an end of the terminal 2*a* penetrates the high voltage circuit substrate 4. Accordingly, the terminal 2*a*, the wiring pattern 43, the diode 8, and the wiring pattern 42 form the first conductive path. The terminal 2*a*, a wiring pattern (not illustrated) that connects the terminal 2*a* and the diode 9, the diode 9, and a wiring pattern (not illustrated) that connects the diode 9 and the discharge electrode also form the first conductive path.

The terminal 2*b* is disposed on the upper surface of the high voltage transformer 2 in a corner diagonally positioned with respect to a corner, at which the terminal 2*a* is provided, and is short in length similarly to the terminal 2*a* in the ion generating device 100. Accordingly, the terminal 2*b* and the induction electrode 7 are connected by the lead wire 13.

The lead wire 13 is disposed so as to extend, below the high voltage circuit substrate 4, from the terminal 2*b* to the vicinity of the terminal 2*a*, further extend in a state of being opposed to the wiring pattern 43, more appropriately, extend in substantially parallel to the wiring pattern 43, and reach a linear portion of the induction electrode 7 near the diode 8. An end of the lead wire 13 is connected to the linear portion of the induction electrode 7. Thus, the terminal 2*b*, the lead wire 13, and the induction electrode 7 form the second conductive path.

In the ion generating device 100A configured as described above, the wiring pattern 43 that constitutes part of the first conductive path and the lead wire 13 that constitutes the second conductive path are opposed to each other (desirably substantially parallel to each other), noise is able to be reduced similarly to the ion generating device 100.

Embodiment 3

Embodiment 3 of the disclosure is described as follows with reference to FIG. 7. Note that, for convenience of description, an element having the same function as that of the element described in Embodiment 1 is given the same reference sign and description thereof is omitted.

Figure 7:
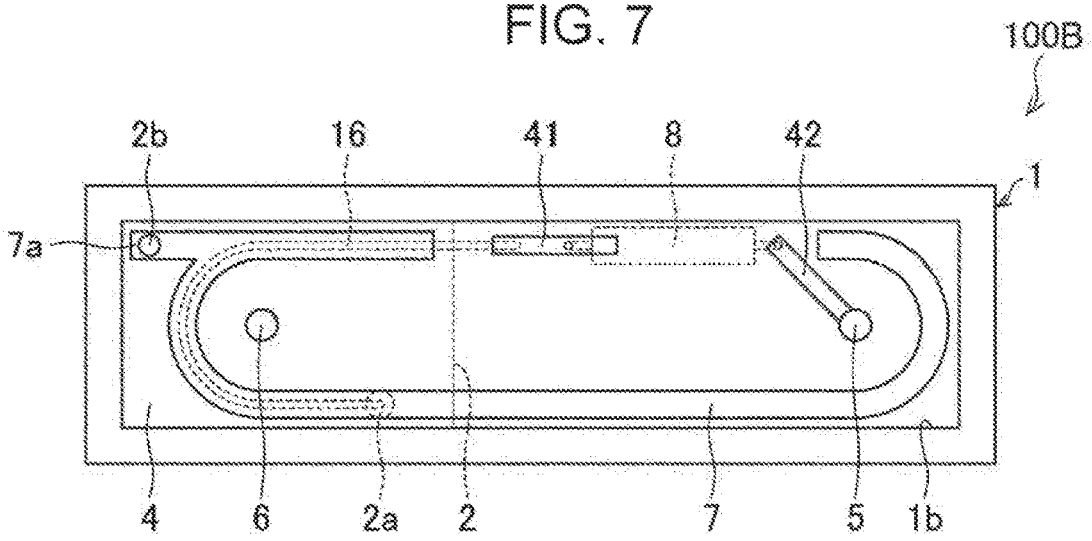
FIG. 7 is plan view illustrating a configuration of an ion generating device according to Embodiment 3 of the disclosure.

FIG. 7 is a plan view illustrating a configuration of an ion generating device 100B according to the present embodiment.

In the present embodiment, a part different from the ion generating device 100 of Embodiment 1 described above is mainly described.

As illustrated in FIG. 7, the ion generating device 100B of the present embodiment is different from the ion generating device 100 in that the position of the terminal 2*a* and the position of the terminal 2*b* are switched in the high voltage transformer 2. Accordingly, the induction electrode 7 has a connection portion 7*a* extending from part of the induction electrode 7, which is near the discharge electrode 6, to the terminal 2*b* so that the induction electrode 7 is connected to the terminal 2*b* protruding from the front surface of the high voltage circuit substrate 4. Further, the ion generating device 100B has a lead wire 16 instead of the lead wire 11 (refer to FIG. 1).

The lead wire 16 is the same as the lead wire 11 in terms of connecting the terminal 2*a* and the wiring pattern 41, but is different from the lead wire in a path in which the lead wire 16 is disposed. The lead wire 16 is disposed below the induction electrode 7 so as to be opposed to and extend along the induction electrode 7.

Accordingly, the lead wire 16 is longer than the lead wire 11 and is thus able to be closer to the induction electrode 7. Therefore, a section where the lead wire 16 and the induction electrode 7 are substantially parallel is able to be made longer. As a result, a noise reduction effect is further enhanced.

Embodiment 4

Embodiment 4 of the disclosure is described as follows with reference to FIGS. 8 to 10. Note that, for convenience of description, an element having the same function as that of the element described in Embodiment 1 is given the same reference sign and description thereof is omitted.

Figure 8:
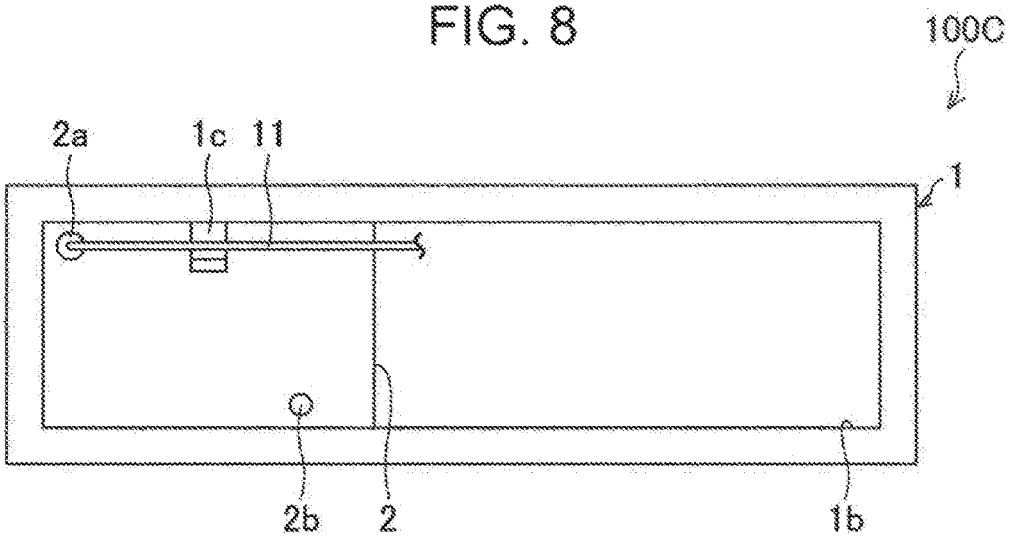
FIG. 8 is plan view illustrating a configuration of an ion generating device according to Embodiment 4 of the disclosure.

FIG. 8 is a plan view illustrating a configuration of an ion generating device 100C according to the present embodiment. FIG. 9 is a longitudinal sectional view illustrating a sectional structure of the ion generating device 100C in a longitudinal direction. FIG. 10 is a sectional view taken along line X-X in FIG. 9. Note that, for convenience of description, illustration of the high voltage circuit substrate 4 and the drive circuit substrate 3 is omitted in FIG. 8.

In the present embodiment, a part different from the ion generating device 100 of Embodiment 1 described above is mainly described.

Figure 9:
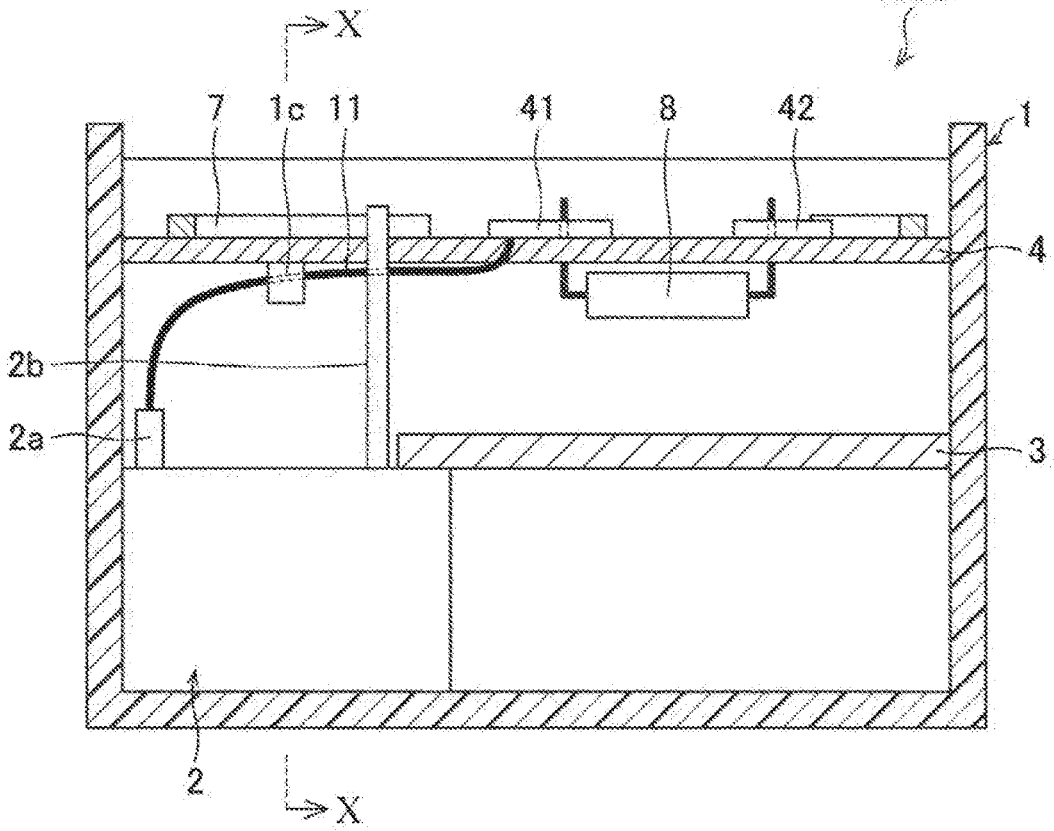
FIG. 9 is a longitudinal sectional view illustrating a sectional structure in a longitudinal direction of the ion generating device illustrated in FIG. 8.
Figure 10:
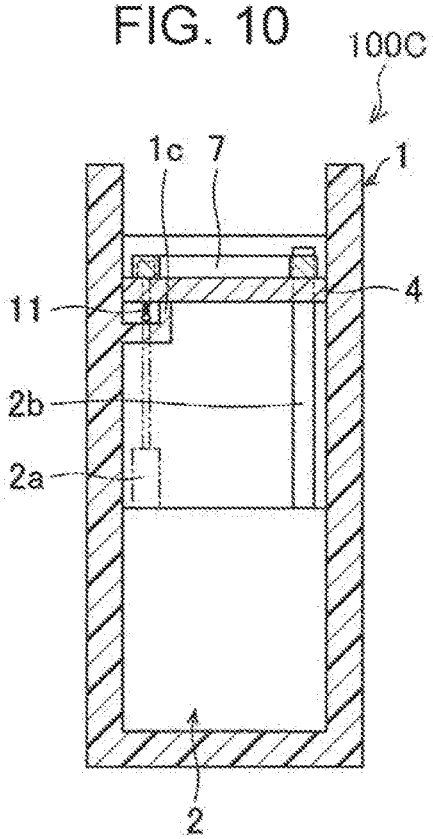
FIG. 10 is a sectional view taken along line X-X in FIG. 9.

As illustrated in FIGS. 8 to 10, the ion generating device 100C of the present embodiment is different from the ion generating device 100 in that the housing 1 has a wire holding portion 1*c*.

The wire holding portion 1*c* is provided at any appropriate position in a path, in which the lead wire 11 is disposed, on an inner wall of the housing 1. The wire holding portion 1*c* is desirably provided at a position where the wire holding portion 1*c* is able to hold the lead wire 11 before the lead wire 11 extending from the terminal 2*a* toward the high voltage circuit substrate 4 is substantially parallel to the rear surface of the high voltage circuit substrate 4. The wire holding portion 1*c* is formed as a recess so as to receive the lead wire 11 from a lower side. An upper end of the wire holding portion 1*c* is in contact with the rear surface of the high voltage circuit substrate 4. Thus, the wire holding portion 1*c* and the high voltage circuit substrate 4 hold the lead wire 11 so that the lead wire 11 does not come out of the wire holding portion 1*c*.

According to the ion generating device 100C configured as described above, the lead wire 11 is held in the housing 1 by the wire holding portion 1*c*, and thus, even if the lead wire 11 has flexibility as described above, a posture thereof is maintained. Moreover, even if the rigid lead wire 11 as described above is used, the posture thereof is easily maintained. Accordingly, the lead wire 11 and the induction electrode 7 are able to be easily opposed to each other.

Note that, the wire holding portion 1*c* is able to be applied so as to hold the conductor 14 in the modification of Embodiment 1 or the lead wires 13 and 16 of the ion generating devices 100A and 100B of Embodiments 2 and 3. Therefore, the wire holding portion 1*c* is formed at a position and in shape corresponding to arrangement positions and shapes of the conductor 14 or the lead wires 13 and 16.

Embodiment 5

Further, Embodiment 5 of the disclosure is described as follows with reference to FIG. 11. Note that, for convenience of description, elements having the same function as those of the elements described in Embodiments 1 to 4 are given the same reference signs and description thereof is omitted.

Figure 11:
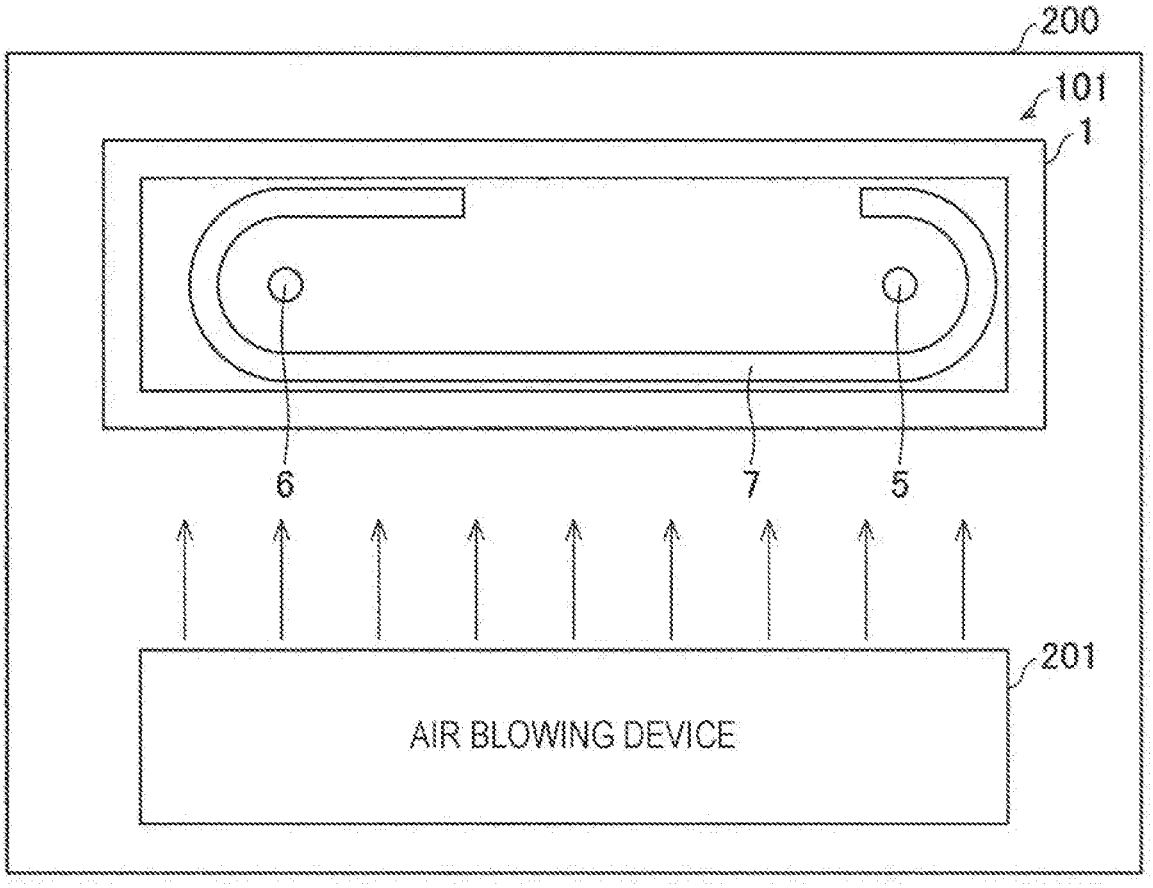
FIG. 11 is a plan view illustrating a schematic configuration of an air cleaner according to Embodiment 5 of the disclosure.

FIG. 11 is a plan view illustrating a schematic configuration of an air cleaner 200 (electronic equipment) according to the present embodiment.

As illustrated in FIG. 11, the air cleaner 200 includes an ion generating device 101 and an air blowing device 201. The ion generating device 101 is any one of the ion generating devices 100A to 100C in Embodiments 1 to 3.

The air blowing device 201 generates a flow of air in a direction indicated by an arrow in FIG. 11 in order to send out ions generated by the ion generating device 101.

In the air cleaner 200 configured as described above, ions generated by electric discharge between the discharge electrodes 5 and 6 and the induction electrode 7 are sent out by being carried by a flow of air generated by the air blowing device 201.

By including the ion generating device 101, the air cleaner 200 is able to be configured in a small size and with a low cost as compared to an air cleaner including a conventional ion generating device. Moreover, even when a conventional ion generating device is not able to be mounted in the air cleaner 200 due to the size thereof, the ion generating device 101 is able to be mounted in the air cleaner 200.

Note that, although an example in which the ion generating device 101 is mounted in the air cleaner 200 has been described in the present embodiment, the ion generating device 101 may be mounted in, other than the air cleaner 200, electronic equipment such as an air conditioner, a cleaner, a refrigerator, a washing machine, or a dryer. Such electronic equipment is able to be configured in a small size and with a low cost in the same manner as the air cleaner 200 as compared to electronic equipment including a conventional ion generating device.

Conclusion

A discharge device according to an aspect 1 of the disclosure includes: a transformer; a discharge electrode that is connected to a first terminal of the transformer on a secondary side; and an induction electrode that generates a discharged product between the induction electrode and the discharge electrode and is connected to a second terminal of the transformer on the secondary side, in which a first conductive path includes the first terminal and extends from the first terminal to the discharge electrode and a second conductive path includes the second terminal and the induction electrode, part of the first conductive path is located in proximity and opposed to part of the second conductive path.

According to the aforementioned configuration, since the secondary side of the transformer is not grounded, waveforms of voltages appearing at the respective first terminal and second terminal of the transformer have opposite phases. Therefore, noise generated in the first conductive path and noise generated in the second conductive path also have opposite phases. Thus, since part of the first conductive path and part of the second conductive path are opposed to each other, at least part of the noise generated in the first conductive path and part of the noise generated in the second conductive path are cancelled each other. Accordingly, a shield or the like that shields against noise is excluded. A discharge device that has a small size and is capable of reducing noise is able to be achieved.

In the discharge device according to an aspect 2 of the disclosure, in the aspect 1, the first conductive path and the second conductive path may be disposed so as to be substantially parallel in part of a portion where the part of the first conductive path is located in proximity and opposed to the part of the second conductive path.

According to the aforementioned configuration, in a portion where the first conductive path and the second conductive path are parallel, an effect of cancelling the noise is further enhanced.

In the discharge device according to an aspect 3 of the disclosure, in the aspect 2, the first conductive path or the second conductive path may include a wire member.

According to the aforementioned configuration, by appropriately adjusting arrangement and/or a shape of the wire member, the first conductive path and the second conductive path are able to be easily opposed to each other.

In the discharge device according to an aspect 4 of the disclosure, in the aspect 3, the wire member may be a lead wire coated with an insulating coating member.

According to the aforementioned configuration, since the lead wire is insulated, a short-circuit fault due to the lead wire being in contact with a wiring pattern or the like around the lead wire is able to be avoided.

In the discharge device according to an aspect 5 of the disclosure, in the aspect 3, the wire member may be a conductor in a plate shape.

According to the aforementioned configuration, a range in which the first conductive path and the second conductive path are opposed to each other is made large by using the conductor in a plate shape.

The discharge device according to an aspect 6 of the disclosure may further include a housing in which the transformer, the discharge electrode, the induction electrode, the first conductive path, and the second conductive path are accommodated, in which the housing may have a wire holding portion that holds the wire member, in any of the aspects 3 to 5.

According to the aforementioned configuration, since the wire member is held in the housing, a posture of the wire member is able to be maintained. Accordingly, the first conductive path and the second conductive path are able to be easily opposed to each other.

The discharge device according to an aspect 7 of the disclosure may further include a diode that half-wave rectifies an AC voltage output from the transformer, in which the discharge electrode may be connected to the first terminal via the diode, the wire member may connect the first terminal and the diode, and part of the wire member may be located in proximity and opposed to part of the second conductive path, in any of the aspects 3 to 5.

A portion of the first conductive path, which extends from the diode to the discharge electrode is not opposed to the second conductive path due to arrangement of the diode in some cases. On the other hand, according to the aforementioned configuration, part of the first conductive path and part of the second conductive path are able to be located in proximity and opposed to each other by the wire member.

The discharge device according to an aspect 8 of the disclosure may further include a single substrate on which the discharge electrode and the induction electrode are provided, in any of the aspects 1 to 7.

According to the aforementioned configuration, since the discharge electrode and the induction electrode are provided on a single substrate, the number of components is able to be reduced as compared to a case where the discharge electrode and the induction electrode are formed on individual substrates. This makes it possible to reduce cost of the discharge device.

Electronic equipment according to an aspect 9 of the disclosure may include the discharge device according to any of the aspects 1 to 8.

According to the aforementioned configuration, it is possible to achieve size reduction and noise reduction of the electronic equipment.

ADDITIONAL MATTER

The disclosure is not limited to each of the embodiments described above and may be modified in various manners within the scope indicated in claims, and an embodiment achieved by appropriately combining techniques disclosed in different embodiments is also encompassed in the technical scope of the disclosure. Further, by combining the techniques disclosed in the embodiments, a new technical feature may be formed.

The present disclosure contains subject matter related to that disclosed in Japanese Priority Patent Application JP 2019-127817 filed in the Japan Patent Office on Jul. 9, 2019, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A discharge device comprising:

a transformer;

a discharge electrode connected to a first terminal of the transformer on a secondary side; and an induction electrode that generates a discharged product between the induction electrode and the discharge electrode and is connected to a second terminal of the transformer on the secondary side, wherein a first conductive path includes the first terminal and extends from the first terminal to the discharge electrode and a second conductive path includes the second terminal and the induction electrode, part of the first conductive path being located in proximity and opposed to part of the second conductive path, the first conductive path and the second conductive path are disposed so as to be substantially parallel, in a plan view, in part of a portion where the part of the first conductive path is located in proximity and opposed to the part of the second conductive path, and the first conductive path includes another portion inclined in a vertical direction.

2. The discharge device according to claim 1, wherein the first conductive path or the second conductive path includes a wire member.

3. The discharge device according to claim 2, wherein the wire member is a lead wire coated with an insulating coating member.

4. The discharge device according to claim 2, wherein the wire member is a conductor in a plate shape.

5. The discharge device according to claim 2, further comprising a housing in which the transformer, the discharge electrode, the induction electrode, the first conductive path, and the second conductive path are accommodated, wherein the housing has a wire holding portion that holds the wire member.

6. The discharge device according to claim 2, further comprising a diode that half-wave rectifies an alternating-current voltage output from the transformer, wherein the discharge electrode is connected to the first terminal via the diode, the wire member connects the first terminal and the diode, and part of the wire member is located in proximity and opposed to part of the second conductive path.

7. The discharge device according to claim 1, further comprising a single substrate on which the discharge electrode and the induction electrode are provided.

8. Electronic equipment comprising the discharge device according to claim 1.

* * * * *